US005251463A

United States Patent [19]

Lonati et al.

[11] Patent Number: 5,251,463

[45] Date of Patent: Oct. 12, 1993

[54] THREAD GUIDE STRUCTURE FOR CIRCULAR KNITTING MACHINE, IN PARTICULAR FOR LINE-FORMING UNITS IN DOUBLE-CYLINDER MACHINES FOR MANUFACTURING SOCKS AND STOCKINGS

[75] Inventors: Francesco Lonati; Ettore Lonati; Fausto Lonati; Tiberio Lonati, all of Brescia, Italy

[73] Assignee: Lonati S.r.l., Brescia, Italy

[21] Appl. No.: 944,763

[22] Filed: Sep. 14, 1992

[30] Foreign Application Priority Data

Sep. 19, 1991 [IT] Italy ..... 91 A002476

[51] Int. Cl.[5] ..... D04B 15/60

[52] U.S. Cl. ..... 66/140 R; 66/138

[58] Field of Search ..... 66/133, 138, 139, 140 R

[56] References Cited

U.S. PATENT DOCUMENTS

| | | | |
|---|---|---|---|
| 2,885,874 | 5/1959 | Polach | 66/140 |
| 3,331,220 | 7/1967 | Bastuscheck et al. | 66/140 R |
| 3,555,855 | 1/1971 | Billi | 66/138 |
| 4,391,105 | 7/1983 | Lonati | 66/138 |
| 5,046,333 | 9/1991 | Sawazaki et al. | 66/140 R |
| 5,070,709 | 12/1991 | Guell | 66/140 R |

FOREIGN PATENT DOCUMENTS

| | | |
|---|---|---|
| 1102631 | 10/1955 | France . |
| 2198496 | 3/1974 | France . |
| 542526 | 1/1942 | United Kingdom . |
| 2155505 | 9/1985 | United Kingdom . |

*Primary Examiner*—Clifford D. Crowder
*Assistant Examiner*—John J. Calvert
*Attorney, Agent, or Firm*—Guido Modiano; Albert Josif

[57] ABSTRACT

The thread guide structure for double-cylinder circular knitting machines comprises a thread guide body which has an elongated configuration and has, proximate to one of its longitudinal ends, a thread dispensing passage. The thread guide body has a first part and a second part which are mutually articulated proximate to an intermediate region of the thread guide body. The first part, which is provided with the thread dispensing passage, is oscillatable with respect to the second part about an oscillation axis which is arranged transversely to the longitudinal extension of the thread guide body.

20 Claims, 2 Drawing Sheets

THREAD GUIDE STRUCTURE FOR CIRCULAR KNITTING MACHINE, IN PARTICULAR FOR LINE-FORMING UNITS IN DOUBLE-CYLINDER MACHINES FOR MANUFACTURING SOCKS AND STOCKINGS

BACKGROUND OF THE INVENTION

The present invention relates to a thread guide structure for circular knitting machines, in particular for line-forming, units in double-cylinder machines for manufacturing socks and stockings.

As is known, in double-cylinder circular knitting machines the thread is fed to the needles of the machine by sets of thread guides, also known as line-forming units, which are arranged at each feeding station of the machine laterally to the needle cylinders. In known line-forming units, each thread guide can be actuated individually in order to pass from an inactive position, wherein its thread dispensing end is spaced from the needle cylinders so as to prevent the needles from engaging the thread, to an active position, wherein the thread dispensing end is moved closer to the needle cylinders in order to allow the correct feeding of the thread to the needles.

By means of line-forming units it is possible to feed, to a same feed of the machine, threads having different colors, counts and components, so as to meet the various production requirements.

The passage of each thread guide from the inactive position to the active position is obtained with various types of actuation device which cause an oscillation of the thread guide about an axis which is parallel to the axis of the needle cylinders and subsequently a translatory motion of the thread guide toward the needle cylinders.

In some kinds of knitting it is necessary to feed the machine with two or more thread guides of a same line-forming unit; in order to allow the needles to correctly engage the threads, the thread delivery ends of said thread guides must be extremely close to each other in the active position.

Furthermore, in some cases the thread guide which is subsequently actuated must pass over a thread guide which has been actuated previously and is thus already in the active position.

In order to achieve this effect, the line-forming unit is provided, on the opposite side with respect to the needle cylinders, with a plate in which an appropriate path is defined; the thread guide engages said path so that, in moving from the inactive position to the active position, or vice versa, it follows said path and thus does not interfere with any thread guide which might be already in the active position. The use of plates in which thread guide paths are defined complicates the manufacture of the line-forming units and the calibration of the thread guides. Furthermore, precision in the actuation of the thread guides decreases in the course of time due to the unavoidable wear of said plates.

Another problem which can be observed in the use of these plates is linked to the increase in bulk which they entail in the line-forming units in a region of the machine where space problems are particularly important.

SUMMARY OF THE INVENTION

The aim of the present invention is to solve the problems described above by providing a thread guide with such a structure as to require no guides in order to pass over any other thread guides which are already active in a same line-forming unit or, more generally, obstacles located along the path which it must follow in order to move from the inactive position to the active position or vice versa.

Within the scope of this aim, an object of the invention is to provide a thread guide with such a structure as to considerably simplify the manufacture and calibration of line-forming units in knitting machines.

Another object of the invention is to provide a thread guide with good operating precision.

A further object of the invention is to provide a thread guide which has competitive production costs.

This aim, these objects and others which will become apparent hereinafter are achieved by a thread guide structure for circular knitting machines, in particular for line-forming units in double-cylinder circular knitting machines for manufacturing socks and stockings comprising a thread guide body having an elongated configuration and, proximate to one of its longitudinal ends, a thread dispensing passage, characterized in that said thread guide body is constituted at least by one first part and by one second part which are mutually articulated proximate to an intermediate region of the thread guide body, said first part being provided with said thread dispensing passage and being oscillatable with respect to said second part about an oscillation axis arranged transversely to the longitudinal extension of said thread guide body.

BRIEF DESCRIPTION OF THE DRAWINGS

Further characteristics and advantages of the invention will become apparent from the description of a preferred but not exclusive embodiment of the thread guide structure according to the invention, illustrated only by way of non-limitative example in the accompanying drawings, wherein.

DESCRIPTION OF THE PREFERRED EMBODIMENTS

Figure 1:
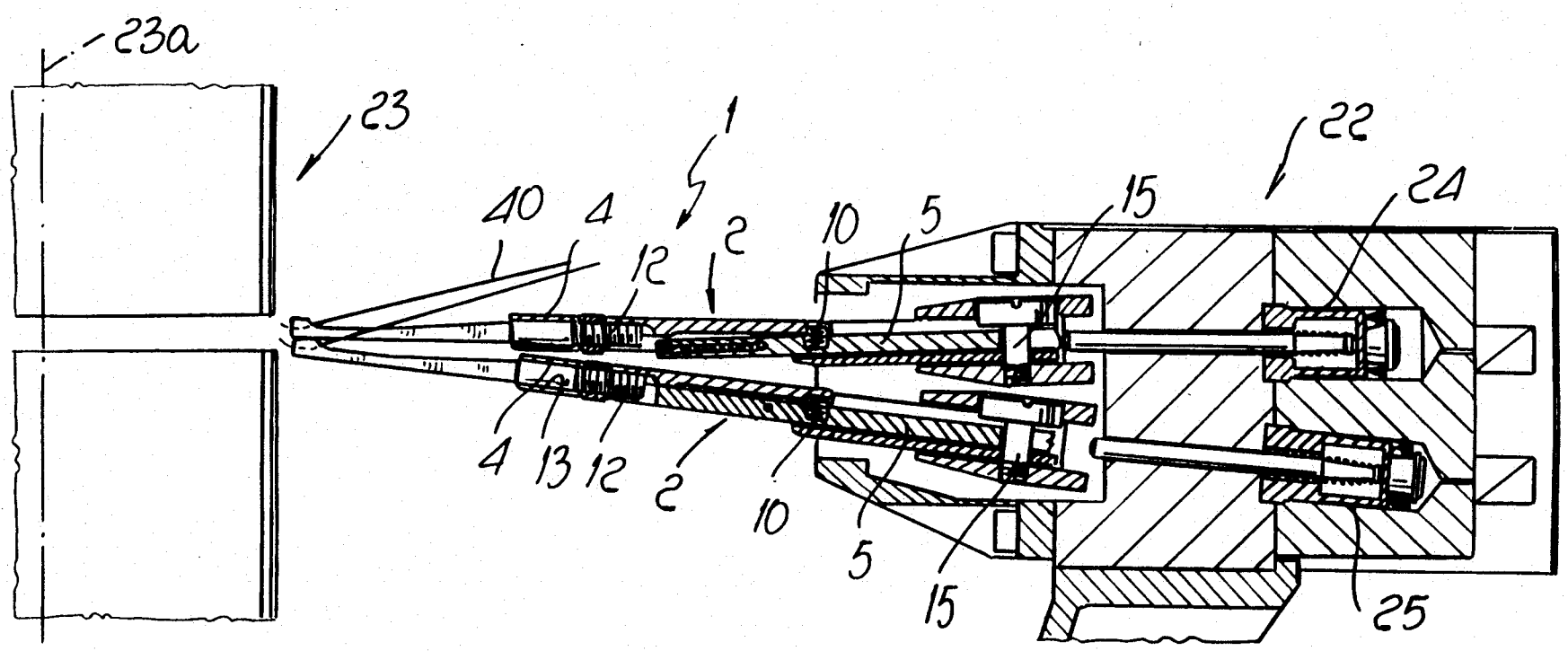
FIG. 1 is a partially sectional lateral elevation view of a line-forming unit which is arranged laterally close to the needle cylinders of a double-cylinder knitting machine with two thread guides according to the invention.
Figure 5:
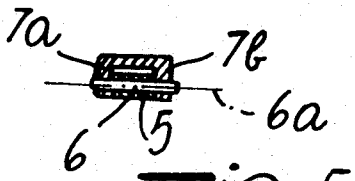
FIG. 5 is a sectional view of FIG. 4, taken along the axis V—V.
Figure 6:
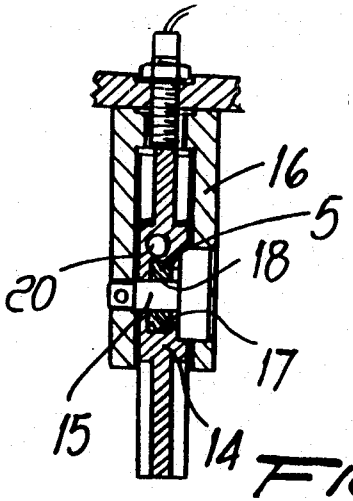
FIG. 6 is a schematic sectional view of FIG. 2, taken along the plane VI—VI.
Figure 4:
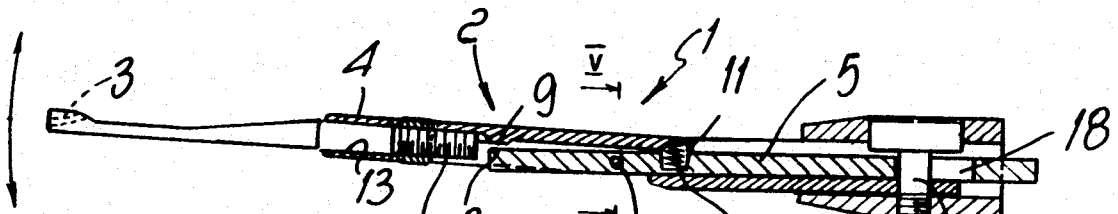
FIG. 4 is a sectional view, taken similarly to FIG. 3, which shows the oscillation of the first part of the thread guide body with respect to the second part thereof.
Figure 3:
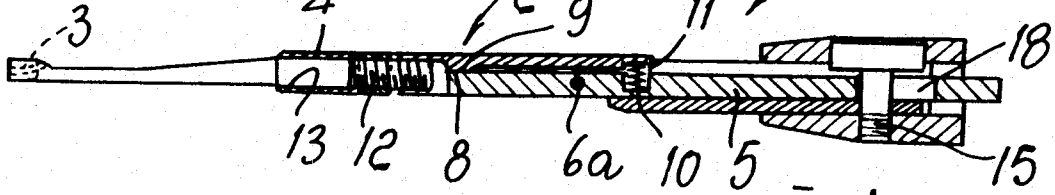
FIG. 3 is a sectional view of FIG. 2, taken along the plane III—III.
Figure 2:
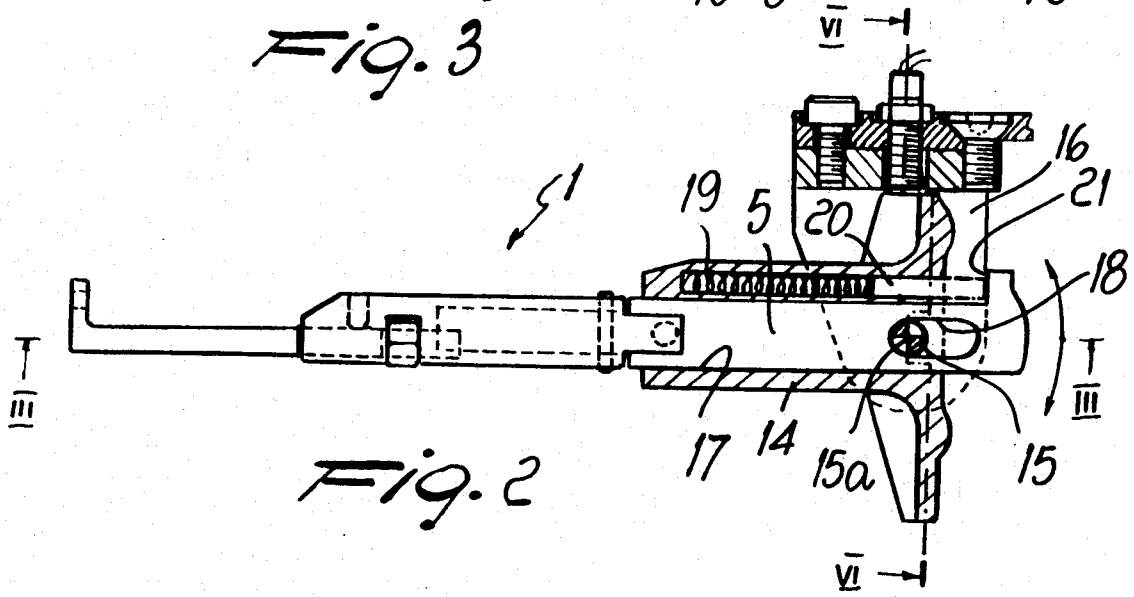
FIG. 2 is a top plan view of a thread guide according to the invention.

With reference to the above figures, the thread guide having the structure according to the invention, generally designated by the reference numeral 1, comprises a thread guide body 2 which is substantially rod-like and has, at one of its longitudinal ends, a passage 3 for dispensing the thread 40.

According to the invention, the body 2 is constituted by at least one first part 4 and by at least one second part 5 which are mutually articulated proximate to an intermediate region of the thread guide body. The first part 4, which is provided with the dispensing passage 3, can oscillate with respect to the second part 5 about an oscillation axis 6a which is arranged transversely to the longitudinal extension of the thread guide body 2.

More particularly, the first part 4 is substantially C-shaped proximate to the second part 5, with two opposite wings 7a and 7b between which a portion of the second part 5 is inserted. The wings 7a and 7b of the first part 4 are associated, so as to be able to rotate, with the second part 5 by means of a pivot 6 which defines the oscillation axis 6a.

The portion of the second part 5 which is arranged between the wings 7a and 7b extends along the first part 4 beyond the pivot 6 so as to define a supporting region 8 for a stop abutment 9 provided in the first part 4 so as to delimit the oscillation arc, in one direction, of the first part 4 with respect to the second part 5.

The oscillation arc of the first part 4 with respect to the second part 5 in the opposite direction is delimited by a spring 10 which rests against the lower side of the first o part 4 and is accommodated in an appropriate seat 11 defined in the back of the second part 5. The spring 10 is arranged, with respect to the pivot 6, on the opposite side with respect to the stop abutment 9 so as to act as elastic return means which contrasts the oscillation of the first part 4 with respect to the second part 5.

In this manner, the first part 4 can oscillate with respect to the second part 5 about the oscillation axis 6a from a first position, wherein the first part 4 is substantially aligned with the second part 5, to a second position, wherein the first part 4 is inclined with respect to the second part 5, and the oscillation of the first part 4 in order to move from the first position to the second position is elastically contrasted by the spring 10.

Conveniently, the first part 4 is manufactured in two pieces which are mutually associated by means of a coupling constituted by a male thread 12 and a female thread 13 whose axis is parallel to the longitudinal axis of the thread guide body, so as to allow to calibrate the useful length of the thread guide.

The thread guide body 2 is mounted on a supporting element 14 which is associated, by means of a pivot 15, with a supporting block 16 so as to be oscillatable, with respect to the supporting block 16, about the axis 15a of the pivot 15.

The axis 15a is arranged transversely to the longitudinal extension of the thread guide and is perpendicular to the axis 6a of the pivot 6 so that the thread guide can oscillate, together with the supporting element 14, about the axis 15a in a plane and so that the first part 4 can oscillate, with respect to the second part 5, about the axis 6a in a plane which is perpendicular to the plane of oscillation of the thread guide as a whole.

The thread guide body 2 is furthermore coupled to the supporting element 14 so as to be slidable along a direction which is parallel to its longitudinal extension.

More particularly, the first part 5 is coupled, so as to be longitudinally slidable, within a seat 17 defined in the supporting element 14.

A slot 18 is defined in the second part 5 and is elongated along a direction which is parallel to the longitudinal extension of the thread guide; said slot is crossed by the pivot 15 which, in this manner, delimits the length of the sliding of the thread guide body with respect to the supporting element 14.

The thread guide body slides toward its thread dispensing end against the biasing action of a spring 19 which is inserted in an appropriate seat 20 defined in the supporting element 14 and acts with one of its ends against a shoulder 21 of the second part 5.

The thread guide according to the invention can be actuated with known actuation means, for example fluid-activated cylinders, electromagnetic actuators, cams, which act on the thread guide body 2 and/or on the supporting element 14 so as to cause the oscillation of the thread guide about the axis 15a and the sliding of the thread guide body parallel to its longitudinal extension with respect to the supporting element 14.

Merely by way of example, FIG. 1 shows a line-forming unit, generally designated by the reference numeral 22, which is equipped with two thread guides 1 according to the invention and laterally faces the needle cylinders 23 of a double-cylinder circular knitting machine.

In this application, the thread guide according to the invention is arranged so that its axis 15a is substantially parallel to the axis 23a of the needle cylinders 23 or slightly inclined so as to cause the thread dispensing ends of a plurality of thread guides to converge in the direction of the needle cylinders.

In this manner, in order to pass from the inactive position to the active position, each thread guide of the line-forming unit, as in known line-forming units, oscillates, for example by virtue of the action of known actuation means, in a plane which is substantially perpendicular or inclined with respect to the axis 23a, and the thread guide body is moved longitudinally in order to move its end for delivering the thread 40 closer to the needle cylinders.

For the sake of completeness in description, it should be noted that FIG. 1 shows, merely by way of example, two fluid-activated actuators 24 and 25 for the actuation of the thread guides. Naturally, the actuation of the thread guide according to the invention could also be obtained with electromagnetic actuators, cams, etc.

The operation of the thread guide according to the invention is as follows.

As already described, in order to be moved from the inactive position to the active position, the thread guide 1 is caused to oscillate about the axis 15a and subsequently the thread guide body 2 is moved longitudinally.

If the first part 4 of the thread guide encounters a thread guide which is already active during this movement, the impact against said thread guide causes the oscillation of the first part 4 with respect to the second part 5. In this manner, the first part 4 of the thread guide which is actuated subsequently can surmount the previously actuated thread guide or in any case rest above it or below it, according to requirements.

Naturally, by fitting a same line-forming unit with a plurality of thread guides according to the invention, the surmounting action can occur by virtue of the oscillation of the first part 4 of the subsequently actuated thread guide or due to the oscillation of the first part 4 of the previously actuated thread guide.

In practice it has been observed that the thread guide according to the invention fully achieves the intended aim, since by virtue, of the fact that its body is manufactured in two mutually articulated parts, it can surmount other thread guides which are already active, or obstacles in general, without requiring the use of any guide.

The thread guide thus conceived is susceptible to numerous modifications and variations, all of which are within the scope of the inventive concept; thus, for example, the first part 4 can be articulated to the second part 5 so as to be oscillatable in the direction opposite to the one shown; furthermore, all the details may be replaced with technically equivalent elements.

In practice, the materials employed, as well as the dimensions, may be any according to the requirements and the state of the art.

We claim:

1. Thread guide structure for circular knitting machines comprising a thread guide body having an elongated configuration and, proximate to a longitudinal end, a thread dispensing passage, wherein said thread guide body has at least one first part and one second part mutually articulated proximate to an intermediate region of the thread guide body, said first part provided with said thread dispensing passage and oscillatable with respect to said second part about an oscillation axis arranged transversely to a longitudinal extension of said thread guide body, wherein said thread guide body is mounted on a supporting element oscillatable associated with a supporting block for oscillation of the thread guide in a plane about the oscillation axis of said supporting element with respect to said supporting block, said first part of the thread guide body being pivoted to said second part about an axis substantially parallel to the plane of oscillation of the thread guide for an oscillation of said first part in a plane substantially perpendicular to the plane of oscillation of the thread guide.

2. Thread guide structure, according to claim 1, wherein said supporting element is associated with said supporting block by means of a pivot arranged transversely to the extension of the thread guide body and substantially at right angles to the oscillation axis of said first part with respect to said second part, said pivot slidably passing through a slot defined in said second part and having a configuration elongated along a direction parallel to the longitudinal extension of the thread guide body.

3. Thread guide structure for circular knitting machines comprising;

a support block (16)

a thread guide body (2) having a longitudinal extension and oscillatably connected to said support block (16) at a pivot axis (15*a*);

at least one first part (4) and one second part (5) defined by said thread guide body (2) and being mutually articulated proximate to an intermediate region of the thread guide body (2);

a thread dispensing passage (3) located proximate to a longitudinal end of said first part (4) of said thread guide body (2);

an oscillation axis (6*a*) arranged transversely with respect to said longitudinal extension of said thread guide body (2), said first part (4) and said thread dispensing passage (3) being oscillatable with respect to said second part (5) about said oscillation axis (6*a*).

4. Thread guide structure according to claim 3, wherein said oscillation axis (6*a*) is perpendicular to said pivot axis (15*a*).

5. Thread guide structure according to claim 3, wherein said first part defines opposite wings (7*a*, 7*b*), a portion of said second part (5) being inserted between said wings (7*a*, 7*b*) and connected thereto by a pivot member (6), said pivot member (6) defining said oscillation axis (6*a*).

6. Thread guide structure according to claim 5, wherein said first part (4) has connected thereto an abutment (9), said portion of said second part (5) inserted between said wings (7*a*, 7*b*) cooperating with said abutment (9) for delimiting oscillation of said first part (4) with respect to said second part (5).

7. Thread guide structure according to claim 5, wherein said first part (4) has connected thereto an abutment (9), and wherein said second part has defined therein a seat (11), said seat (11) housing elastic return means (10), said portion of said second part (5) inserted between said wings (7*a*, 7*b*) cooperating with said abutment (9) for delimiting oscillation of said first part (4) with respect to said second part (5), said first part (4) cooperating with said elastic return means (10) for contrasting said oscillation of said first part (4) with respect to said second part (5) about said oscillation axis (6*a*).

8. Thread guide according to claim 3, wherein said first part (4) of said thread guide body (2) comprises two pieces interconnected by a male thread (12) and a female thread (13), said male thread (12) and said female thread (13) each having an axis parallel to said elongated configuration of said thread guide body (2), whereby to permit thread guide length calibration.

9. Thread guide structure according to claim 3, wherein said thread guide body (2) is mounted on a supporting element (14), said supporting element (14) being pivotally connected to said supporting block (16) at said pivot axis (15*a*).

10. Thread guide structure according to claim 9, further comprising;

a seat (17) defined in said supporting element (14), said first part (4) being slideably coupled to said seat (17);

an elongate slot (18) defined in said second part (5) and extending parallel to said longitudinal extension of said thread guide body (2), a pivot (15) traversing said elongate slot (18) and defining said pivot axis (15*a*), whereby to delimit sliding of said thread guide body (2) with respect to said supporting element (14).

11. In combination, a circular knitting machine (23) having a needle cylinder (23) defining a needle cylinder axis (23*a*), and a thread guide comprising;

a support block (16) connected to said circular knitting machine (23);

a thread guide body (2) having a longitudinal extension and oscillatably connected to said support block (16) at a pivot axis (15*a*);

at least one first part (4) and one second part (5) defined by said thread guide body (2) and being mutually articulated proximate to an intermediate region of the thread guide body (2);

a thread dispensing passage (3) located proximate to a longitudinal end of said first part 4) of said thread guide body (2);

an oscillation axis (6*a*) arranged transversely with respect to said longitudinal extension of said thread guide body (2), aid first part (4) and said thread dispensing passage (3) being oscillatable with respect to said second part (5) about said oscillation axis (6*a*).

12. Combination according to claim 11, wherein said pivot axis (15*a*) is substantially parallel to said needle cylinder axis (23*a*).

13. Combination according to claim 11, wherein said pivot axis (15*a*) is inclined with respect to said needle cylinder axis (23*a*).

14. Combination according to claim 11, wherein said oscillation axis (6*a*) is perpendicular to said pivot axis (15*a*).

15. Combination according to claim 11, wherein said first part defines opposite wings (7a, 7b), a portion of said second part (5) being inserted between said wings (7a, 7b) and connected thereto by a pivot member (6), said pivot member (6) defining said oscillation axis (6a).

16. Combination according to claim 15, wherein said first part (4) has connected thereto an abutment (9), said portion of said second part (5) inserted between said wings (7a, 7b) cooperating with said abutment (9) for delimiting oscillation of said first part (4) with respect to said second part (5).

17. Combination according to claim 15, wherein said first part (4) has connected thereto an abutment (9), and wherein said second part has defined therein a seat (11), said seat (11) housing elastic return means (10), said portion of said second part (5) inserted between said wings (7a, 7b) cooperating with said abutment (9) for delimiting oscillation of said first part (4) with respect to said second part (5), said first part (4) cooperating with said elastic return means (10) for contrasting said oscillation of said first part (4) with respect to said second part (5) about said oscillation axis (6a).

18. Combination to claim 11, wherein said first part (4) of said thread guide body (2) comprises two pieces interconnected by a male thread (12) and a female thread (13), said male thread (12) and said female thread (13) each having an axis parallel to said elongated configuration of said thread guide body (2), whereby to permit thread guide length calibration.

19. Combination according to claim 11, wherein said thread guide body (2) is mounted on a supporting element (14), said supporting element (14) being pivotally connected to said supporting block (16) at said pivot axis (15a).

20. Combination according to claim 19, further comprising;

a seat (17) defined in said supporting element (14), said first part (4) being slideably coupled to said seat (17);

an elongate slot (18) defined in said second part (5) and extending parallel to said longitudinal extension of said thread guide body (2), a pivot (15) traversing said elongate slot (18) and defining said pivot axis (15a), whereby to delimit sliding of said thread guide body (2) with respect to said supporting element (14).

* * * * *

UNITED STATES PATENT AND TRADEMARK OFFICE

CERTIFICATE OF CORRECTION

PATENT NO. : 5,251,463
DATED : October 12, 1993
INVENTOR(S) : Lonati Francesco, et. al.

It is certified that error appears in the above-indentified patent and that said Letters Patent is hereby corrected as shown below:

On the Title page, item [30], change "91 A002476" to --MI91 A002476--.

Signed and Sealed this
Fifth Day of April, 1994

Bruce Lehman

*Attest:*

BRUCE LEHMAN

*Attesting Officer*

*Commissioner of Patents and Trademarks*